US006459381B2

(12) United States Patent
Carson et al.

(10) Patent No.: US 6,459,381 B2
(45) **Date of Patent: *Oct. 1, 2002**

(54) APPARATUS FOR DETECTING OPERATION OF AN ELECTRIC FENCE AND FENCE CHARGER

(75) Inventors: Anthony R. Carson, Waynoka, OK (US); Kiet Q. Lam, Waynoka, OK (US)

(73) Assignee: Tru-Test Limited, Auckland (NZ)

( * ) Notice: Subject to any disclaimer, the term of this patent is extended or adjusted under 35 U.S.C. 154(b) by 0 days.

This patent is subject to a terminal disclaimer.

(21) Appl. No.: 09/811,040

(22) Filed: Mar. 16, 2001

Related U.S. Application Data

(63) Continuation-in-part of application No. 09/384,728, filed on Aug. 27, 1999.

(51) Int. Cl.[7] ..... G08B 21/00

(52) U.S. Cl. ..... 340/660; 340/635; 340/654; 340/664

(58) Field of Search ..... 340/660, 635, 340/654, 664, 539, 540, 541, 870.27; 324/133

(56) References Cited

U.S. PATENT DOCUMENTS 4,171,523 A * 10/1979 Parkitny ..... 340/654
4,220,949 A * 9/1980 Pope et al. ..... 340/533
4,318,088 A * 3/1982 Hunter ..... 340/541
4,829,298 A * 5/1989 Fernandes ..... 340/870.27
5,285,195 A * 2/1994 Way et al. ..... 340/635
5,982,291 A1 * 7/2001 Carson et al. ..... 340/660

* cited by examiner

*Primary Examiner*—Edward Lefkowitz
*Assistant Examiner*—Davetta W. Goins
(74) *Attorney, Agent, or Firm*—Kenneth E. Darnell

(57) ABSTRACT

Detection apparatus for sensing the operational state of an electric fence and thus an electric fence charger intended to maintain an electric charge on the fence, the invention and the several embodiments thereof find compatibility with known fence chargers whether pulse or continuous in appropriate supply voltage ranges. The detection apparatus of the invention includes a power supply such as a battery to drive a light source such as a light emitting diode which is caused to flash by circuitry carried by the apparatus, the apparatus being clipped to the fence at any location thereof to connect the circuitry to the electrical load on the fence. The light source operates in the event of a failure of the fence charger to perform properly including conditions ranging from complete failure to voltage drops of a predetermined degree or in the event of an open circuit such as can be caused by a separated fence conductor such as a fence wire. The circuitry of the invention includes in the several embodiments thereof control functions based on the operation of an integrated circuit or a transistor in combination with other circuit elements.

7 Claims, 3 Drawing Sheets

APPARATUS FOR DETECTING OPERATION OF AN ELECTRIC FENCE AND FENCE CHARGER

CROSS REFERENCE TO RELATED APPLICATION

This application is a continuation-in-part of U.S. patent application Ser. No. 09/384,728, filed Aug. 27, 1999, by the same inventors and assigned to the same assignee.

BACKGROUND OF THE INVENTION

1. Field of the Invention

The invention relates generally to apparatus for detection of the proper function of an electric fence and/or a fence charger intended to maintain charge on the fence. More particularly, the invention relates to a compact and durable sensing device which can be readily mounted onto or near an electric fence for detecting proper operation of the fence and of a charging device intended to maintain a nominally steady or periodically applied charge on the fence.

2. Description of the Prior Art

The imposition of an electrical charge on fencing intended to maintain livestock within a specified area has become well known as an alternative or addition to the fencing of livestock or the like by means of conventional fencing intended to retain such stock by virtue of the strength of the fencing rather than by an electrical charge which causes the stock to avoid the fencing. Electric fencing is charged to an appropriate voltage by means of fence charging apparatus which typically apply either continuous or pulsed current to at least one electrical conductor comprising the fencing. Examples of presently available electric fence chargers include the random pulse charging apparatus of Phillips et al which is disclosed in U.S. Pat. No. 4,316,232. McKissack, in U.S. Pat. No. 4,859,869, discloses the use of transformers for applying a continuous charge for energization of an electric fence. Standing, in U.S. Pat. Nos. 4,394,583 and 4,691,084, describe electrical fence chargers as does Shaw et al in U.S. Pat. No. 5,381,298.

While electric fence and fence charger combinations usually provide satisfactory operation, certain circumstances can occur whereby a fence can lose its electrical charge either by failure of the fence charger or by damage to the fence itself such as by cutting of the fence or other circumstance which causes an open circuit or "short" condition. While fence charging apparatus may employ visual or audible signals on the apparatus itself to indicate failure or incipient failure of the fence charger, it is not possible to determine these conditions unless personnel are deployed in the area of the fence chargers per se in order to detect such indications. Accordingly, a need has been felt in the art to provide a simple and inexpensive means by which an observer at essentially any location along an electric fence can be informed of the operational state of the electric fence so that a determination can be made in the event of an indicated failure as to whether a failure of the fence charger exists or whether conductive elements of the electric fence have been breached such as by cutting or other separation thus causing an open or short circuit. The art has previously provided monitoring and alarm systems used in association with electric fences and fence chargers. Begg, in U.S. Pat. No. 4,523,187, provides one such alarm while Pope et al, in U.S. Pat. No. 4,220,949, provides a fence monitor as does Hamm in U.S. Pat. No. 5,550,530. McCutchan et al, in U.S. Pat. No. 4,297,633, provides remote devices on electric fence sections whereby the devices transmit signals to a central control location. Although the art has provided monitoring and alarm systems such as are represented by the United States patents cited herein, the art continues to feel the need for a compact and inexpensive device which can be placed on a conductive element of an electric fence and which provides a signal, particularly a visual signal in the form of a flashing light, in the event of the inability of a fence charger to maintain an electric charge on the fence or the lack of a charge on any portion of the fence such as can occur due to heavy vegetation loading that portion of the fence or a separation of at least one of the electrical conductors of the fence such as by cutting or any separation of electrical conductors or collapse of any portion of the fence causing an open or short circuit. The present invention provides in a compact, inexpensive and exceptionally durable apparatus circuitry for sensing the operational state of an electric fence and/or the electric fence charger intended to maintain an electric charge on the fence and in the several embodiments thereof finds compatibility with known fence chargers whether pulsed or continuous.

SUMMARY OF THE INVENTION

The invention provides a compact, inexpensive and exceptionally durable device which can be simply attached at a multiplicity of locations on or in close proximity to a conductive portion of an electric fence with contact thus being provided between the fence and circuitry internal of the device, any desired number of the present devices being usable without drawing down voltage. The device of the invention in its several embodiments includes a self-contained power source such as batteries of appropriate size and voltage, a circuit board carrying circuitry elements, a source of illumination disposed within the device and a shock-resistant "plastic" lens which forms at least a part of a housing within which components of the device are disposed and interrelated for appropriate function. The devices of the invention may be disposed at locations sufficiently close to electrified wire fence conductors such that electric field is sensed even though the devices of the invention do not actually contact electrically charged wire conductors.

Circuitry suitable to an appropriate operation of the invention can take a variety of forms according to the invention with that part of the circuitry causing communication with the electric fence and/or with the fence charger being a clip or other mounting arrangement which simply and readily fits over an electrical conductor of the electric fence at any location of the fence or an electric potential sensing means such as an electrically conductive element housed within the device and positioned sufficiently close to an electrical conductor of the fence, the clip, other mounting arrangement or electric potential sensing means being directly connected to circuitry internal of the device, which circuitry causes operation of the device to provide an appropriate visual signal in the event of the failure of the fence to exhibit an appropriate charge or the failure of the fence charger to appropriately charge the fence. The circuitry can also sense when voltage drops below a predetermined value and provides a signal indication of such a voltage drop. A particularly useful circuit defined according to the invention includes an integrated circuit as a part of the circuitry providing control, an output from the integrated circuit causing a transistor to oscillate, oscillation of the transistor controlling a light source carried by the device. It should be understood that the light source is preferably carried within the device in order to prevent damage to the light source. In this preferred circuit, the integrated circuit functions essentially as a timer and further provides means for adopting other functions to the circuitry as desired. For example, self-test functions or the like can be incorporated into the preferred circuitry due to the presence within the circuitry of the integrated circuit comprising the timer function. In a similar vein, auxiliary subsystems can be connected into the circuitry through the integrated circuit to provide other functions without any real modification of the original circuit.

The invention further contemplates provision of a control and/or timing function by means of the operation of discrete circuit elements including at least one resistor and at least one transistor which function to control the oscillation of a transistor and thus control of the light source. It is to be understood that the light source in the several embodiments of the invention can take several forms including low voltage DC lamps of the incandescent types as well as light emitting diodes of various description, it being desirable to utilize light emitting diodes having the capability of flashing operation.

In the several embodiments of the present circuitry, it is to be noted that the circuitry is not grounded to earth ground, be it represented by earth return wires and/or earth in the vicinity of the device's location, and that the electrical reference is at the battery negative terminal. As can be appreciated, electrical reference could also be to the battery positive terminal or any other point in the circuit that is at a nominally fixed voltage with respect to the battery negative terminal according to well-known electrical principles. Accordingly, it is thus seen that the impedance of air between the device's circuitry and earth ground and in at least one embodiment also to the fence conductor is used to prevent lowering of the voltage of the fence charger and also to provide one or two large series impedances in a potential divider wherein a second or third series impedance is provided at the input of the device's circuitry.

The invention in its several embodiments will be seen to be compatible with all types of fence chargers whether pulse or continuous and will accept wide ranges of supply voltages such as from 3 to 15 volts DC. The present devices function within a wide range of temperatures and within a wide range of weather conditions. The devices of the invention further will not drop the voltage of the fence charger, a clip connecting the device to the fence or an electric potential sensing means such as an electrically conductive element housed within the device and positioned sufficiently close to an electrical conductor of the fence further connecting directly to circuitry within the device and providing input from the fence charger to such circuitry. The clip provides a means for hanging the devices of the invention on a high voltage fence wire without danger of shock. The illumination source of the several devices of the invention only flashes when a fence charger is not working properly or when the fence voltage at the location of the device is below a predetermined threshold, such as occurs when the fence has an open or short circuit.

Accordingly, it is a primary object of the invention to provide a detection apparatus in several embodiments for sensing the operational state of an electric fence and/or the electric fence charger intended to maintain an electric charge on the fence, the detection apparatus being of compact, inexpensive and durable construction and housing circuitry and an illumination source driven by the circuitry, whereby the circuitry detects charge on the electric fence at any location thereof and provides an indication of malfunction when such charge does not exist due either to fence charger failure or the presence of an open circuit or a significantly higher than normal load on at least the portion of the fence where the detection apparatus is located.

It is another object of the invention to provide compact and inexpensive detection devices capable of sensing the operational state of an electric fence including operation at a reduced voltage below a predetermined level at any location thereof as well as the appropriate function of an electric fence charger, the devices of the invention being usable at multiple locations and simply being clipped to or hung on or otherwise positioned in close proximity to electrically conductive fence elements of an electric fence at any location of the electric fence to provide an indication of the appropriate functioning of the fence and fence charger without drawing down the voltage imposed on the fence by the charger.

It is a further object of the invention to provide detection apparatus for sensing the operational state of an electric fence and/or the electric fence charger whereby an illumination source carried by the apparatus will be caused to flash in the event of a failure of the fence charger or the existence of an open circuit such as can be caused by a separated fence wire.

It is a still further object of the invention to provide an apparatus for sensing the operational state of an electric fence and/or fence charger electrically connected to the fence and intended to maintain an electrical charge on the fence, the apparatus including a housing, a power supply and an indicator, the improvement comprising a first circuit carried by the housing for sensing the electric field of at least a portion of the electric fence, the circuit being ungrounded to earth, a second circuit operable by the first circuit on reduction of the electric field for operating the power supply to drive the indicator and thereby to indicate a malfunction of the fence and/or the fence charger, and means electrically connected to the first circuit for disposition relative to the portion of the electric fence to allow the first circuit to sense the electric field of said portion of the electric fence, said means being disposed sufficiently close to but not necessarily touching the electric fence to allow sensing of the electric field.

Yet another object of the invention is to provide apparatus for sensing the operational state of an electrical fence and/or fence charger electrically connected to the fence and intended to maintain an electrical charge on the fence, the apparatus including a housing, a power supply and an indicator, the improvement comprising a first circuit carried by the housing for sensing the electric field of at least a portion of the electric fence, the circuit being ungrounded to earth and a second circuit operable by the first circuit on reduction of the electric field for operating the power supply to drive the indicator and thereby to indicate a malfunction of the fence and/or the fence charger.

Further objects and advantages of the invention will become more readily apparent in light of the following detailed description of the preferred embodiments.

DESCRIPTION OF THE PREFERRED EMBODIMENTS

Figure 1:
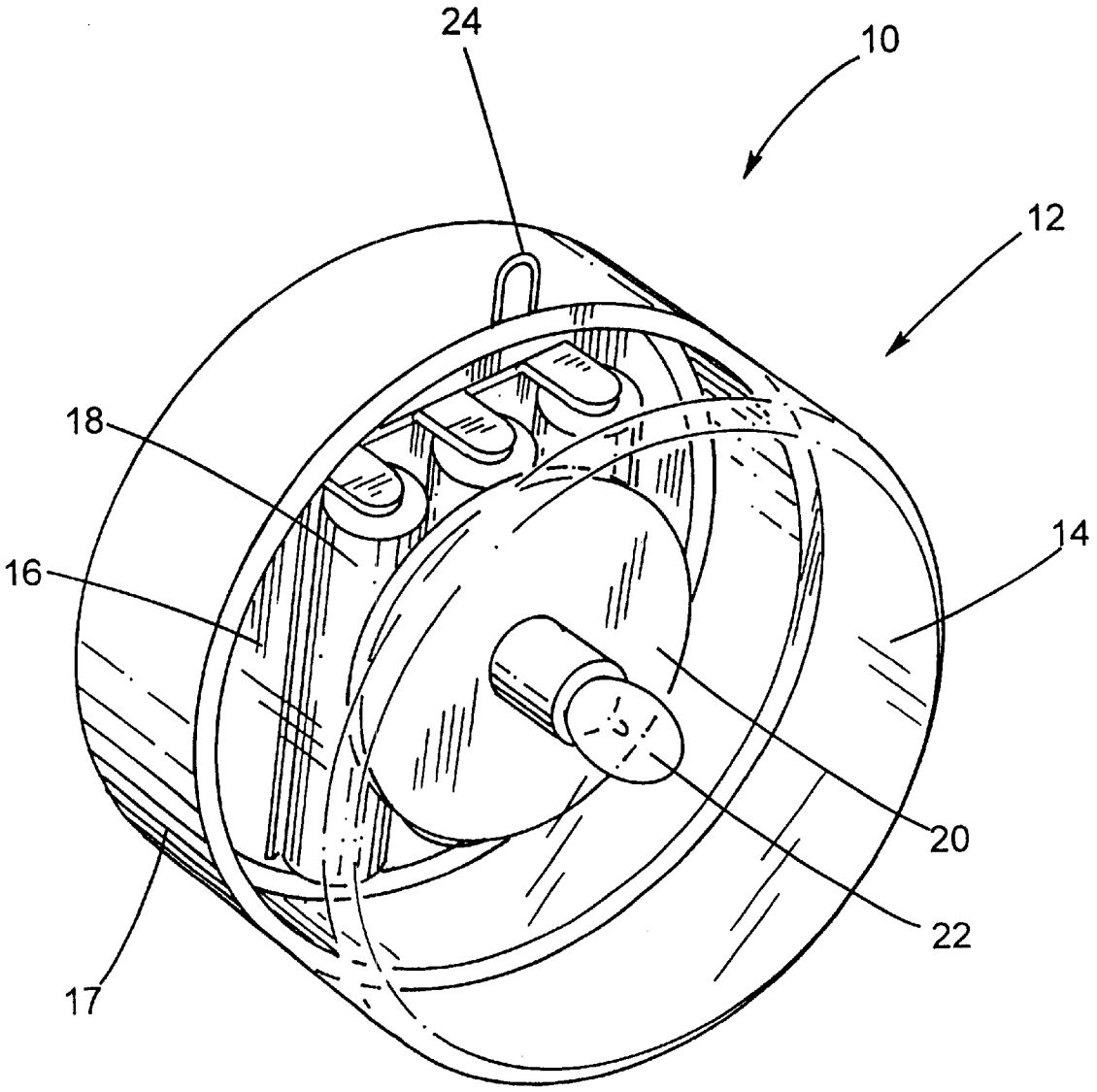
FIG. 1 is an idealized perspective view illustrating a detection device configured according to the invention and including a housing carrying a power source, an illumination source, controlling circuitry and a clip or similar mechanism for hanging the assembly to a portion of an electric fence in order to effectively communicate the condition of the fence and of a fence charger intended to charge the fence to circuitry contained within the apparatus of the invention.

Referring now to the drawings and particularly to FIG. 1, a detector configured according to the invention is seen generally at 10 to comprise a housing 12 formed of a lens element 14 and a back plate 16. A power source such as batteries 18 is mounted in any convenient fashion to an inner surface of the back plate 16, the back plate 16 then being mounted either directly to the lens element 14 or to a rear housing element 17 in any convenient fashion. For example, the back plate 16 can be provided with screw threads (not shown) which mate with threads formed about an opening in the element 17 so that the back plate 16 can be conveniently and positively attached to the housing 12. The lens element 14 and the rear housing element 17 can be permanently attached to each other or can be integrally formed, it only being necessary for the lens element 14 to be formed of a clear, "plastic" material having sufficient durability to withstand the rigors of the outdoor environment within which the detector 10 is intended to function.

Interiorly of the housing 12 and in a position to direct light through the lens element 14 is disposed a light source 22, the operation of which is controlled by circuitry 26 mounted on a circuit board 20, the circuit board 20 being mounted in any convenient fashion within the interior of the housing 12. It is to be understood that reflector elements can be provided within the interior of the housing in order to efficiently reflect light through the lens element 14. Further, the lens element 14 can preferably be formed of a material having a color tint which would cause illumination of the light source 22, especially flashing illumination, to be more readily observed. In practice, an amber light emitting diode coupled with yellow reflective materials or yellow-tinted materials is preferred.

Figure 2:
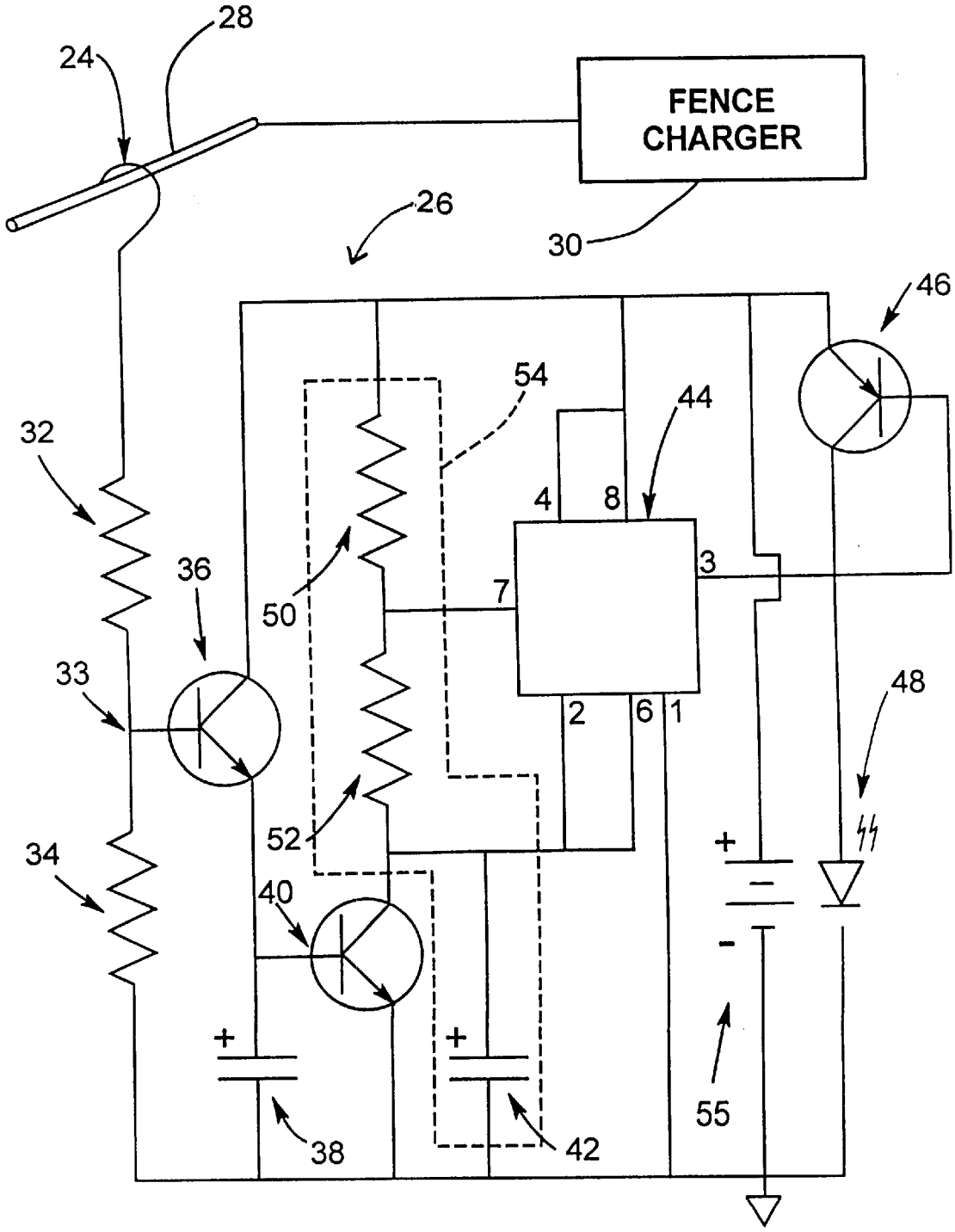
FIG. 2 is a circuit diagram illustrating a preferred embodiment of the circuitry of the invention; and, FIG. 3 is a block diagram illustrating an alternative circuit which can be used in the device of FIG. 1.
Figure 3:
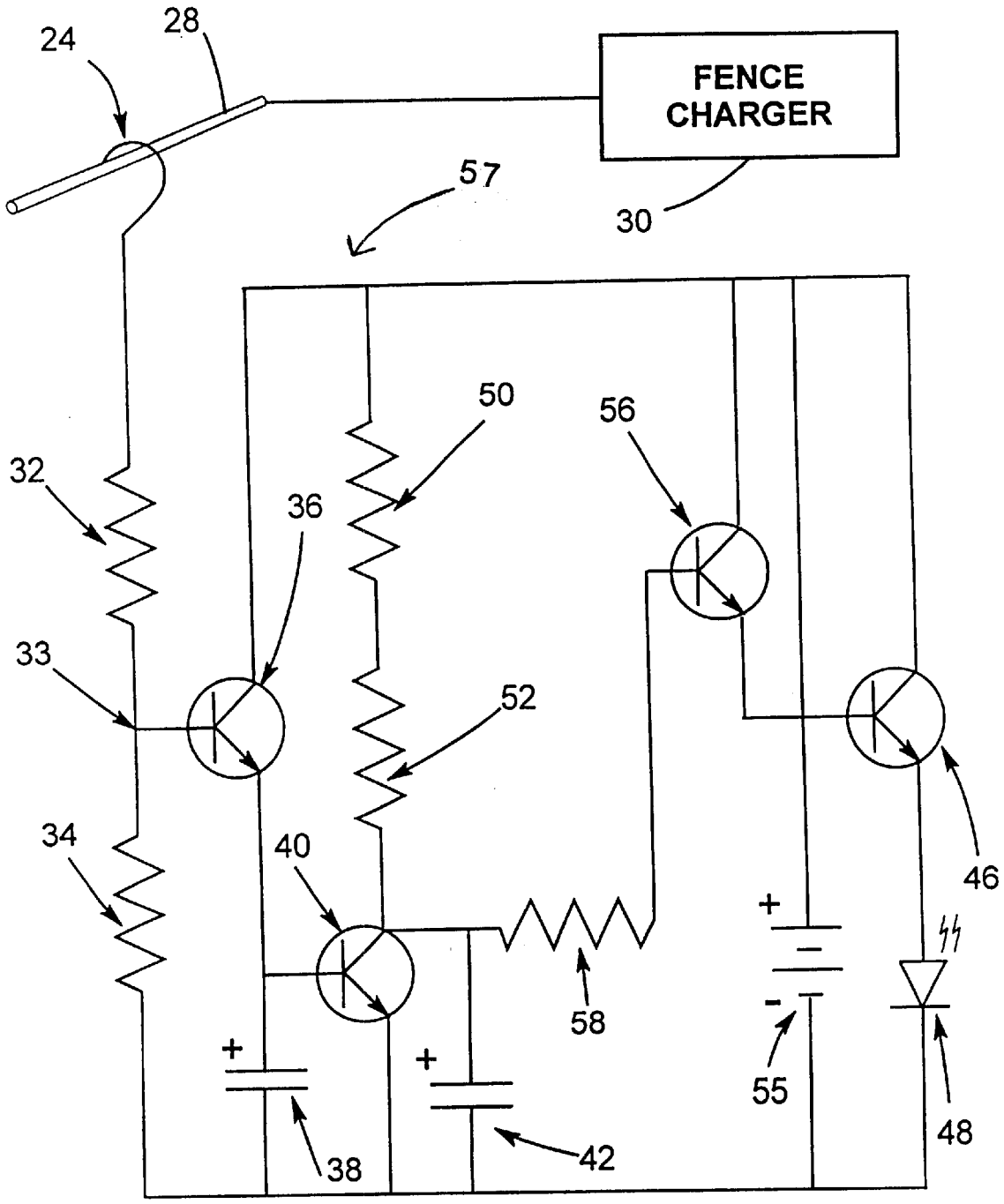

A connector 24 is mounted to the housing 12 and has conductive elements (not shown) which extend into electrical contact with the circuitry 26 mounted on the circuit board 20. Electrical connection between this connector 24 and the circuitry 26 is illustrated in FIGS. 2 and 3.

The connector 24 not only provides a mechanism by which the detector 10 can be mounted to, that is, "hung" onto an electrically conductive fence element (not shown in FIG. 1), the connector 24 also couples the circuitry 26 of the detector 10 to an electrically conductive fence element and therefore a fence charger (shown in FIGS. 2 and 3) without providing a shock risk. In particular, the circuitry 26 of the detector 10 is not grounded to earth ground, the electrical reference of the detector 10 thus preferably being at the negative terminal of the battery or batteries 18. Accordingly, the impedance of the air in the vicinity of the hanging connection and between the detector 10 and earth ground acts to prevent lowering of the voltage of the fence charger. This grounding of the detector 10 to the negative terminal of the battery 18 rather than to earth ground is of very substantial importance in that any number of the detectors 10 can be hung onto an electric fence without drawing down voltage on the fence, thereby allowing detection of the operational state of the fence charger 30 and of the fence at any desired number of locations by any desired number of the detectors 10 at any given time. Further, a drop in voltage on the fence to a predetermined degree, such as to 1000 volts, can be detected by the detector 10 with a resulting visual indication being provided by said detector.

From the foregoing, it is apparent that the detector 10 need not be hung directly on an electrically conductive fence element. The detector 10 can be mounted to a fence post or the like in juxtaposition to an electrically conductive fence element such that the electric field between the fence element and earth ground, be it represented by earth return wires and/or earth in the vicinity of the device's location, is sensed. Accordingly, an electrically conductive wire of an electric fence does not have to be touched by any portion of the circuitry in detector 10 as long as the detector 10 is close enough to the charged wire in order to detect a flux signal which radiates from the wire with sufficient amplitude to charge the requisite capacitor of the sensing circuit. An impedance in the form of a capacitor and resistor in parallel can separate a sensing circuit of the detector 10 from a charged wire in a manner similar to the separation provided by the air gap. In essence, air in the vicinity of the connection acts as an impedance, just as air between the detector 10 and ground forms an impedance the function of which contributes substantially to the desirable operation of the detector 10.

A consideration of the structure of the detector 10 as seen in FIG. 1 reveals alternatives as to the construction thereof. For example, a light emitting diode can be utilized as the light source 22 and particularly a light emitting diode capable of flashing operation. While a DC-driven light source such as an incandescent bulb can be utilized, power drain on the batteries 18 will be substantially reduced through use of a light emitting diode as the light source 22. The light source 22 is connected into the circuitry 26 in a manner as is disclosed in the discussion of FIGS. 2 and 3 as provided hereinafter. It is further to be understood that the batteries 18 could take the form of disc-type batteries which could be mounted within circular depressions formed in the back plate 16, for example. Such batteries are usually slotted to allow removal from circular depressions which are threaded to mate with threads formed on the batteries themselves.

Referring now to FIG. 2, a preferred circuit is seen as comprising the circuit 26. The circuit 26 of FIG. 2 includes a light emitting diode 48 having flashing capability as the light source 22. The batteries 18 of FIG. 1 are seen to also be a part of the circuit 26 and are described as battery 55 in the circuitry of FIG. 2.

FIG. 2 illustrates an electrically conductive fence element 28 in schematic fashion, such a fence element 28 being typically formed of wire and being that portion of an electric fence on which the connector 24 is hung in order to mount the detector 10 to the electric fence. The fence element 28 is shown in a schematic fashion to be connected to a fence charger 30 which may essentially comprise a charger of any known type whether continuous or pulse and within the usual output voltage ranges of such chargers. When the fence charger 30 is operable to charge the fence element 28 on which the detector 10 is mounted through the connector 24, resistors 32 and 34 sense the voltage provided by the fence charger 30. The fence charger 30 causes a small current to be fed from junction 33 of the resistors 32 and 34, this current flowing to the base of transistor 36 and thereby turning the transistor 36 on. Activation of the transistor 36 charges capacitor 38 with a resultant activation of the transistor 40. When the transistor 40 is thus activated or caused to be in an "on" condition, capacitor 42 is discharged through the transistor 40, thus causing output of timer 44 to go "high". When the output of the timer 44 goes high, transistor 46 turns off and the light source in the form of the light emitting diode 48 is also "off". Accordingly, in the condition whereby the fence charger 30 is properly operating and causing a charge to be imposed upon the fence element 28, and the fence is in good condition, the detector 10 senses the charge imposed upon the fence element 28 and thus senses that the fence charger 30 is performing properly and that the fence is in a good condition such that a charge exists as is expected on the fence element 28. In this condition, the light source, that is, the light emitting diode 48, is inoperative.

In the condition whereby the fence charger is in the "off" condition for any reason such as by actual failure, the charge in the capacitor 38 slowly drops to zero volts, thus preventing the capacitor 42 from being discharged. It is thus seen that the capacitor 42 charges through resistor 50 and resistor 52, a network 54 being essentially formed by the resistors 50, 52 and the capacitor 42. Once the capacitor 42 has charged up to approximately between one-third and two-thirds of the supply voltage, the output of the timer 44 will go "low" and the capacitor 42 will slowly discharge through resistor 52. When the capacitor 42 is discharged below approximately one-third of the supply voltage, the output of the timer 44 will go "high" and the capacitor 42 will be recharged again. This charge/recharge cycle of the capacitor 42 causes the timer 44 to oscillate the transistor 46 since the gate of the transistor 46 is controlled by the output of the timer 44. The rate of oscillation is determined by the product of the resistor 50, the resistor 52 and the capacitor 42 which form the network 54 as indicated previously. The light source, that is, the light emitting diode 48, is controlled by the oscillation of the transistor 46. Accordingly, failure of the fence charger to maintain the appropriate charge on the fence element 28 causes the light emitting diode 48 to flash and thus provide a visual failure indication. The detector 10 thus only provides a visual failure indication when the fence charger 30 is not working properly or when the electric fence voltage at the location of the device is below a predetermined threshold, such as occurs when the fence has an open or short circuit such as can be caused by cutting of the fence or by a separation occurring due to the other causes.

Referring again to FIG. 2, it is seen that the timer 44 takes the form of an integrated circuit, the output of which at 3 controlling the gate of the transistor 46 to thereby oscillate the transistor 46. The integrated circuit comprising the timer 44 provides flexibility to the circuit 26 when considered relative to discrete element circuitry since options can be connected to the circuit 26 through the integrated circuit comprising the timer 44 with minimum or no modification to the circuit 26. Such modifications can include circuit subsystems providing other alarm indicators, self-test functions, etc. The integrated circuit of the circuit 26, that is, the timer 44, can be provided with GND at 1, a TRIGGER function at 2, an OUTPUT function at 3, a RESET function at 4, a THRESHOLD function at 6, a DISCHARGE function at 7 and a VCC function at 8. A control function could be provided at a position such as the 5 position (not shown). The circuit 26 can otherwise be provided with conventional discrete circuit elements. However, it is to be understood that the resistors can preferably be carbon film of ⅛ watt. The light emitting diode 48 should preferably have high efficiency and intensity. Further, all transistors should preferably have a gain of a minimum of 200 while the integrated circuit taking the form of the timer 44 is preferably of the CMOS type. The resistor 50 should preferably be between 1M and 2M for flash rate setting. All electrical components can be surface mounted or through-hole mounted on the circuit board 20. The detector 10 functions maximally with all types of fence chargers and especially where pulses are less than 0.5 Hz or once every two seconds. The flash rate of the detector 10 is approximately once every three seconds. It is further to be noted that the transistors 36 and 40 are NPN type transistors while the transistor 46 is a PNP transistor. The capacitors are typically 1 microfarad, 15 V electrolytic devices. The integrated circuit, that is, the timer 44, is chosen to be a TC 555 CMOS timer.

Referring now to FIG. 3, an alternative circuit is seen at 57 and comprises a number of discrete circuitry elements which are present in the circuit 26 of FIG. 2, these elements functioning in essentially the same manner. However, the timer 44 has a transistor 56 and a resistor 58 substituted therefor. In operation, the resistors 32 and 34 sense voltage when the fence charger 30 is operating appropriately, the fence charger 30 feeding a small current from the junction 33 of the resistors 32, 34, this current flowing to the base of the transistor 36 with the result that the transistor 36 is turned on. The capacitor 38 is charged through the transistor 36 and turns on the transistor 40. When the transistor 40 is in the "on" condition, the capacitor 42 is discharged through the transistor 40 causing the transistor 56 to turn off, the transistor 46 also being caused to turn off so that the light emitting diode 48 is also off. When the fence charger 30 is not functioning, the charge in the capacitor 38 slowly drops to zero volts thus preventing the capacitor 42 from being discharged. As with the circuit 26 of FIG. 2, the capacitor 42 charges through the resistors 50 and 52. When the capacitor 42 has charged up to a voltage causing the transistor 56 to turn on, the transistor 56 simultaneously turns the transistor 46 on, thus causing the light emitting diode 48 to flash. The flash rate of the light emitting diode 48 is determined by the inherent rate of the LED itself.

As is the case with the circuit 26 of FIG. 2, the circuit 57 is not grounded to earth ground, the electrical reference being at the negative terminal of the battery 55. Accordingly, the impedance of the air functions to prevent lowering of the voltage of the fence charger 30. The transistor 46 of the circuit 57 of FIG. 3, is an NPN transistor rather than the PNP transistor of the circuit 26 of FIG. 2.

While the detector 10 including the circuits 26 and 57 have been described as explicit embodiments of the inventive concept disclosed herein, it is to be understood that the conformation of the detector 10 and particular circuit elements can be configured other than as explicitly shown and described herein without departing from the scope of the invention as defined by the appended claims.

What is claimed is:

1. In an apparatus for sensing the operational state of an electrical fence and/or fence charger electrically connected to the fence and intended to maintain an electrical charge on the fence, the apparatus including a housing, a power supply and an indicator, the improvement comprising:

a first circuit carried by the housing for sensing the electric field of at least a portion of the electric fence, the circuit being ungrounded to earth; and, a second circuit operable by the first circuit on reduction of the electric field for operating the power supply to drive the indicator and thereby to indicate a malfunction of the fence and/or the fence charger.

2. In the apparatus of claim 1 wherein the improvement further comprises:

means electrically connected to the first circuit for disposition relative to the portion of the electric fence to allow the first circuit to sense the electric field of said portion of the electric fence.

3. In the apparatus of claim 2 wherein the means comprise an electrically conductive clip for engaging the portion of the electric fence.

4. In the apparatus of claim 2 wherein the means are disposed sufficiently close to but not touching the electric fence to allow sensing of the electric field.

5. In the apparatus of claim 1 wherein the power supply is a battery having a positive terminal and electrical reference is to the battery positive terminal or any other point in the circuit which is at a nominally fixed voltage with respect to the battery negative terminal, the impedance of air between circuitry of the apparatus and earth ground and to a conductor of the fence being used to prevent lowering of the voltage of the fence charger and also to provide one or two large series impedances in a potential divider wherein a second or third series impedance is provided at the input of the circuitry of the apparatus.

6. In an apparatus for sensing the operational state of an electrical fence and/or fence charger electrically connected to the fence and intended to maintain an electrical charge on the fence, the apparatus including a housing, a power supply and an indicator, the improvement comprising:

a first circuit carried by the housing for sensing the electric field of at least a portion of the electric fence, the circuit being ungrounded to earth;

a second circuit operable by the first circuit on reduction of the electric field for operating the power supply to drive the indicator and thereby to indicate a malfunction of the fence and/or the fence charger; and, means electrically connected to the first circuit for disposition relative to the portion of the electric fence to allow the first circuit to sense the electric field of said portion of the electric fence, said means being disposed sufficiently close to but not touching the electric fence to allow sensing of the electric field.

7. In the apparatus of claim 6 wherein the power supply is a battery having a positive terminal and electrical reference is to the battery positive terminal or any other point in the circuit which is at a nominally fixed voltage with respect to the battery negative terminal, the impedance of air between circuitry of the apparatus and earth ground and to a conductor of the fence being used to prevent lowering of the voltage of the fence charger and also to provide one or two large series impedances in a potential divider wherein a second or third series impedance is provided at the input of the circuitry of the apparatus.

* * * * *